US008844625B2

(12) United States Patent
Mhaskar et al.

(10) Patent No.: US 8,844,625 B2
(45) Date of Patent: Sep. 30, 2014

(54) PERFORATING GUN SPACER

(75) Inventors: Nauman H. Mhaskar, Cypress, TX (US); William D. Myers, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 335 days.

(21) Appl. No.: 13/286,886

(22) Filed: Nov. 1, 2011

(65) Prior Publication Data

US 2013/0105146 A1 May 2, 2013

(51) Int. Cl.
*E21B 17/02* (2006.01)
*E21B 43/11* (2006.01)
*E21B 43/119* (2006.01)

(52) U.S. Cl.
CPC ..... *E21B 43/119* (2013.01); *E21B 17/02* (2013.01)
USPC ..... 166/242.6; 166/55.2; 175/4.53

(58) Field of Classification Search
CPC ... E21B 43/11; E21B 43/116; E21B 43/1185; E21B 43/1195; E21B 43/263
USPC ..... 166/242.6, 298, 55.1, 55.2; 175/2, 4.53
See application file for complete search history.

(56) References Cited

U.S. PATENT DOCUMENTS 4,905,759 A 3/1990 Wesson et al.
5,054,564 A 10/1991 Oestreich et al.
5,167,282 A * 12/1992 Schneider et al. ..... 166/297
5,366,013 A * 11/1994 Edwards et al. ..... 166/297
5,429,192 A * 7/1995 Huber et al. ..... 166/297
6,098,716 A * 8/2000 Hromas et al. ..... 166/377
6,865,978 B2 3/2005 Kash
7,055,421 B2 6/2006 Kash
7,210,524 B2 * 5/2007 Sloan et al. ..... 166/55.2
7,231,982 B2 * 6/2007 Sloan et al. ..... 166/378
7,246,548 B2 7/2007 Kash
7,353,866 B2 * 4/2008 Snider et al. ..... 166/55.2
7,600,568 B2 * 10/2009 Ross et al. ..... 166/297
7,621,342 B2 11/2009 Walker
7,896,077 B2 * 3/2011 Behrmann et al. ..... 166/297
8,286,706 B2 * 10/2012 McCann et al. ..... 166/297
8,336,437 B2 * 12/2012 Barlow et al. ..... 89/1.15
8,555,764 B2 * 10/2013 Le et al. ..... 89/1.15
2001/0015275 A1 8/2001 Van Petegem et al.
2002/0033264 A1 * 3/2002 Parrott et al. ..... 166/297
2002/0185275 A1 12/2002 Yang et al.
2006/0070738 A1 4/2006 Sloan et al.
2006/0237190 A1 * 10/2006 Snider et al. ..... 166/250.07
2007/0240873 A1 * 10/2007 George et al. ..... 166/55.1
2007/0277966 A1 * 12/2007 Ross et al. ..... 166/55.1
2009/0084552 A1 * 4/2009 Behrmann et al. ..... 166/298
2010/0071895 A1 * 3/2010 Burleson et al. ..... 166/250.01
2010/0133004 A1 * 6/2010 Burleson et al. ..... 175/2
2011/0000669 A1 * 1/2011 Barlow et al. ..... 166/297
2013/0105146 A1 * 5/2013 Mhaskar et al. ..... 166/242.6

* cited by examiner

*Primary Examiner* — Jennifer H Gay
(74) *Attorney, Agent, or Firm* — Steve Rosenblatt

(57) ABSTRACT

Perforating gun connectors are provided with a small diameter inner tube to house the detonating cord and an outer load-bearing tube that is ported to be in pressure balance. The inner tube controls the volume in the gun for the well fluids to enter after the guns are fired and the initial pressure surge dissipates. The smaller diameter also increases pressure rating and diminishes the chance of plastic deformation. Since the inner tube is inset even some deformation is tolerated without distorting the outer tube due to the space between the tubes. A bored rod is used as a housing member or a layered single outer wall.

11 Claims, 2 Drawing Sheets

PERFORATING GUN SPACER

FIELD OF THE INVENTION

The field of the invention is perforating guns and more particularly the design of connectors for guns attached to each other so as to control the fluid flow from the formation and to prevent housing deformation in the connector which can lead to guns stuck in the well.

BACKGROUND OF THE INVENTION

Perforating guns feature an inner tube that supports the shaped charges and the detonating cord that is connected to the shaped charges. A surrounding housing has machined recesses that are aligned with the shaped charges so that when the gun is set off the released energy exits through the housing recesses and creates perforation tunnels beyond the surrounding tubular that now has been perforated, and creates perforation tunnels through the casing and into the reservoir formation. In the perforation process, the result is often a spike in wellbore pressure as the charges are detonated, and is sometimes followed by a rapid decline in pressure which can cause formation fluids rush into the gun that is now hollow where the charges used to be. This rush of formation fluid is often desired to a point to assist in removing any damage or debris in the perforation tunnel to increase the flow capability from the reservoir. However, too much inflow or pressure reduction in the wellbore can also produce undesirable formation sand or even cause a casing collapse.

It is common practice when perforating multiple intervals of the well that perforating gun assemblies that are loaded with perforating charges are often separated by perforating guns that are not loaded. These non-loaded perforators are referred to as "blanks" or "spacer guns".

Prior designs of connectors between or among guns have had the design shown in FIG. 1. FIG. 1 shows the spacer assembly 10 without the guns that can be attached at the ends. The detonation cord 12 runs through the housing 14. Typical housings used in perforating spacers can be expressed by a diameter-to-wall thickness ratio (D/t) in a range of approximately 7-20. After the guns are shot chambers 16 and 18 are pressurized initially and then upon a reduction in pressure after the shot the formation fluids rush in to fill the volume as the detonation cord 12 is no longer there since it is consumed to shoot the guns. There are several potential issues with this design. First it may provide too much volume for the fluid flow after detonation and may adversely affect the perforation tunnels. In some applications trying to reduce the volumes 16 and 18 is not practical as it will bring the guns too close together. Gun spacing and shot density are other parameters that need to be considered in assembling a gun array for perforation operations.

What can also happen due to rapid pressure swings and shockwave interactions as the guns are shot and the formation fluids rush in is that the housing tubulars 20 or 22 of the blank spacers can be collapsed causing effectively an increased diameter so that retrieval of the guns becomes a problem. The blank spacer housings could also become sheared-off, separating the housing from the other perforating assemblies. The dimensional change due to pressure differential can lead to guns stuck in the well and cause the need for an expensive milling operation. Assemblies that are separated and left in the well require time-consuming "fishing" operations to retrieve the assemblies left in the wellbore.

It is therefore desirable to configure the connectors with a smaller inner tube that can better handle the differential pressures during firing of the guns and to further limit the potential volume in the gun for the formation fluid to fill after the guns are shot. An outer tube that is in pressure balance can because it has a series of holes conforms to the shape of the remaining connector components so that even if the pressurized inner tube is distorted the guns will not be stuck at the connectors since any distortion will not reach the outer tube. This pressure-balanced outer tube maintains the ability as a load-bearing member and provides the rigidity and strength required to convey the perforating assembly into the wellbore. Since this outer tube is pressure balanced, materials having a higher D/t ratio (i.e. "thinner wall") can be employed.

Alternative embodiments such as boring out a rod for the detonation cord or altering the wall thickness of housing tubulars such as 20 or 22 to make them more resistant to deformation while at the same time controlling the volume of the chambers such as 16 and 18 are also contemplated.

The following patents reveal the state of the art for gun design that uses an inner tube to mount the detonating cord and the shots and an outer tube that is perforated in alignment with the shot pattern. These designs do not address the connector design for connectors that are disposed between the guns: U.S. Pat. No. 7,621,342 (FIG. 5); U.S. Pat. No. 6,865,978 (FIG. 8); U.S. Pat. No. 7,246,548 (FIG. 1b); U.S. Pat. No. 7,055,421 (FIGS. 2 and 2A) and U.S. Pat. No. 5,054,564 (FIG. 5).

SUMMARY OF THE INVENTION

Perforating gun connectors are provided with a small diameter inner tube to house the detonating cord and an outer tube that is ported to be in pressure balance prior to firing the perforating guns. The inner tube controls the volume in the gun for the well fluids to enter after the guns are fired and the initial pressure surge dissipates. The smaller diameter also increases pressure rating and diminishes the chance of plastic deformation. Since the inner tube is inset even some deformation is tolerated without distorting the outer tube due to the space between the tubes.

Alternative embodiments with a bored rod as a housing member or with a layered single outer wall effect are also contemplated.

Additional benefit of this invention is realized in high-pressure well environments having formation properties like unconsolidated sandstones that may be prone to producing formation sand during perforation., which can cause the assembly to become stuck in the wellbore. Having this ported outer housing and inner tube configuration allows use of high-pressure spacer gun assemblies with essentially the same outer diameter as the loaded perforating guns. By keeping the effective diameters across the assembly essentially the same, the risk of influx sand gathering in any regions where significant diameter change occurs is eliminated. This further reduces the likelihood of becoming sand-stuck.

BRIEF DESCRIPTION OF THE DRAWNGS

DETAILED DESCRIPTION OF THE PREFERRED EMBODIMENT

Figure 2:
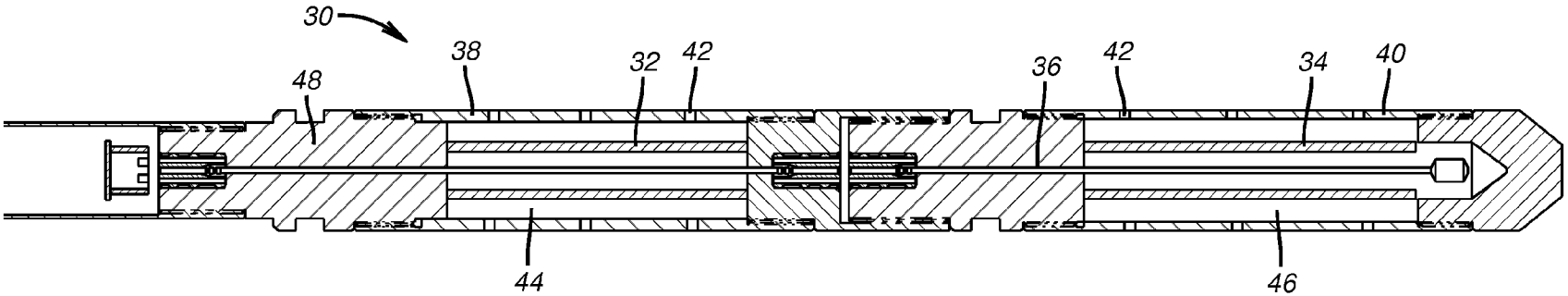
FIG. 2 is a section view of a connector showing the inner tube that contains pressure and a perforated outer tube.

Referring to FIG. 2 the connector 30 has inner tubes 32 and 34 around the detonating cord 36 which are of a smaller diameter than the outer housing tubulars 38 and 40. The outer housing tubulars 38 and 40 are perforated with openings 42 that are of a sufficient size number and location to prevent pressure buildup in annuli 44 or 46. The outer housing tubulars 38 and 40 extend radially a similar distance to end connection 48 but can optionally be larger. The gap provided by annuli 46 and 48 allows room for elastic or plastic deformation of the tubes 32 or 34 without pushing the outer tubes 38 and 40 further out. Deformation of the outer tubes 38 and 40 could result in stuck gun assemblies and would require the guns and associated connectors to be milled out.

Figure 1:
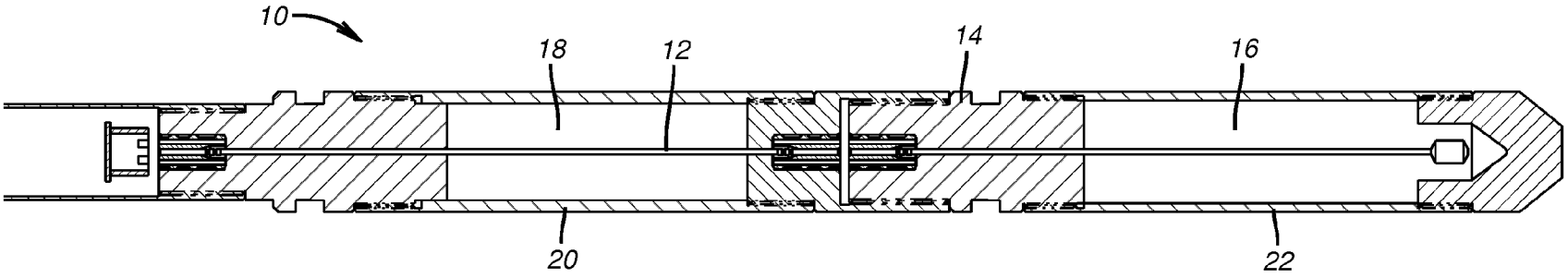
(PRIOR ART) FIG. 1
FIG. 1 is a section view of a prior art connector where the housing outer wall is pressure containing.

The reduction in diameter of the inner tubes 32 and 34 as compared to the larger housing tubes 20 and 22 of the prior art FIG. 1 also increases the pressure rating of the smaller tubes apart from the advantage of creating a space for deformation in the form of annuli 46 and 48 that will not increase the drift of the assembly and preventing stuck guns. The length and diameter of the tubes 32 and 34 can be adjusted to get the desired volume when perforating in an underbalanced condition to control the flow of formation fluids after the initial pressure surge has dissipated.

Figure 3:
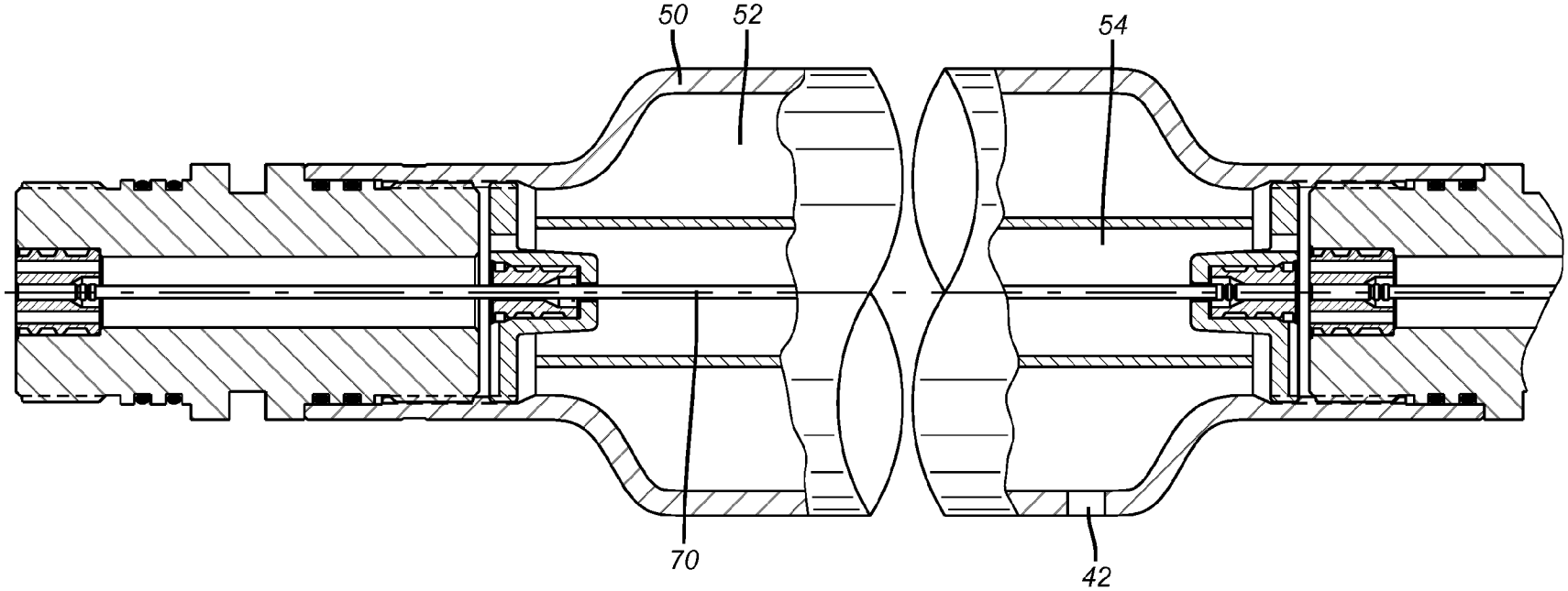
FIG. 3 shows a modification of FIG. 1 to add a schematically illustrated filler material or wall thickness to reduce interior open space in the connector.

FIG. 3 schematically illustrates alternative embodiments. The outer tubes 20 or 22 of the prior art can be made out of a bored solid rod as a way to reduce the volume around the cord 70 to control the formation flow after the guns are shot and it increase the pressure resistance of the structure during the rapid pressure buildup as the guns are fired. By using a solid rod that is bored for the detonating cord 70 the issue of plastic deformation is also minimized or eliminated. As an alternative embodiment the sole outer housing tubular 50 can be made in built up layers represented by item 52 or the interior space 54 can be reduced with filler material to address the flow surge issues with underbalanced perforation either with or without fortifying the housing tubular 50. The filler material can be metal, plastic, cement or organic material that is fairly incompressible. The tubular 50 can be in a singular or multiple layers to achieve either or both the increased strength or the reduction in surge volume.

The above description is illustrative of the preferred embodiment and many modifications may be made by those skilled in the art without departing from the invention whose scope is to be determined from the literal and equivalent scope of the claims below:

We claim:

1. A connector, for perforating guns having charges set off by a detonation cord, comprising:

a housing assembly having at least one end connector to accept a perforating gun;

at least one inner tubular connected to said end connector through which the detonation cord passes to the charges, said inner tubular forms part of an initially sealed conduit with respect to a surrounding annular space, said initially sealed conduit has fluids entering from a formation after the charges are set off at a time when said inner tubular is no longer sealed;

an outer tubular supported by said end connector and mounted over said inner tubular to define said annular space which is free of the charges, said annular space along the substantial length of said outer tubular is in pressure balance with surrounding well fluid in the wellbore at a time before said gun is fired.

2. The connector of claim 1, wherein:

said outer tubular has at least one opening.

3. The connector of claim 2, wherein:

said outer tubular has an outside diameter no greater than said end connector.

4. The connector of claim 2, wherein:

any deformation of said inner tubular occurs in said annulus without deformation of said outer tubular.

5. The connector of claim 4, wherein:

a volume inside said inner tubular is selected to provide a predetermined volume to control surge flow from the formation after the charges are set off.

6. The connector of claim 1, wherein:

said annular space comprises fill material comprising at least one of metal, plastic, cement and organic material.

7. The connector of claim 6, wherein:

any deformation of said inner tubular occurs in said annulus without deformation of said outer tubular.

8. The connector of claim 1, wherein:

said outer tubular has an outside diameter no greater than said end connector.

9. The connector of claim 1, wherein:

a volume inside said inner tubular is selected to provide a predetermined volume to accommodate surge flow from the formation after the charges are set off.

10. The connector of claim 1, wherein:

said outer tubular has a diameter-to thickness ratio ranging 3.2 to 50 inclusive.

11. The connector of claim 1, wherein:

said outer tubular has an outside diameter greater than said end connector.

* * * * *